US007926200B2

(12) United States Patent
Lenoir

(10) Patent No.: US 7,926,200 B2
(45) Date of Patent: Apr. 19, 2011

(54) INFRARED DRIER INSTALLATION FOR PASSING WEB

(75) Inventor: Patrick Lenoir, Villeneuve D'Ascq (FR)

(73) Assignees: NV Bekaert SA, Zwevegem (BE); Bekaert Combustion Technology B.V., Assen (NL)

( * ) Notice: Subject to any disclaimer, the term of this patent is extended or adjusted under 35 U.S.C. 154(b) by 221 days.

(21) Appl. No.: 10/591,393

(22) PCT Filed: Feb. 21, 2005

(86) PCT No.: PCT/EP2005/050732

§ 371 (c)(1),
(2), (4) Date: Nov. 10, 2006

(87) PCT Pub. No.: WO2005/085730

PCT Pub. Date: Sep. 15, 2005

(65) Prior Publication Data

US 2007/0193060 A1 Aug. 23, 2007

(30) Foreign Application Priority Data

Mar. 2, 2004 (FR) ..... 04 02142

(51) Int. Cl.
*F26B 3/34* (2006.01)

(52) U.S. Cl. ..... 34/266; 34/68; 34/92; 162/111; 427/209; 431/326

(58) Field of Classification Search ..... 34/68, 92, 34/266; 162/111; 427/209; 431/326
See application file for complete search history.

(56) References Cited

U.S. PATENT DOCUMENTS

| | | | | | |
|---|---|---|---|---|---|
| 1,387,068 | A | * | 8/1921 | Olson | 419/65 |
| 1,405,780 | A | * | 2/1922 | Harris | 34/89 |
| 1,564,565 | A | * | 12/1925 | Harris | 34/462 |
| 1,742,099 | A | * | 12/1929 | Robertson et al. | 432/77 |
| 1,908,643 | A | * | 5/1933 | Rice | 49/441 |
| 1,919,267 | A | * | 7/1933 | White | 427/120 |
| 1,923,729 | A | * | 8/1933 | Hull | 264/652 |
| 1,971,766 | A | | 8/1934 | Byron et al. | |

(Continued)

FOREIGN PATENT DOCUMENTS

DE 3149003 A1 6/1983

(Continued)

OTHER PUBLICATIONS

Patrick Lenoir, USPTO Office Action, U.S. Appl. No. 10/591,431, Nov. 13, 2009, 15 pages.

(Continued)

*Primary Examiner* — Stephen M. Gravini
(74) *Attorney, Agent, or Firm* — Foley & Lardner LLP

(57) ABSTRACT

Infrared drier installation (1) for a passing web (2), which installation ( ) has gas-heated infrared radiant elements (5), arranged one next to the other so as to form a unit (4). Each unit comprises at least two adjacent rows (8) of gas-heated infrared radiant elements (5) stretching out in he transversal' (9) direction of the web (2) substantially over the entire with of the web (2). The infrared drier installation comprises means to recycle, at least partially, the said combustion gases. The drier installation as subject of the present invention is characterized in that the infrared drier comprises means (16) to avoid the suction of cold air between two adjacent rows of radiant elements (5).

24 Claims, 3 Drawing Sheets

U.S. PATENT DOCUMENTS

| | | | | | |
|---|---|---|---|---|---|
| 2,095,386 | A | * | 10/1937 | Hibberd | 261/3 |
| 2,099,160 | A | | 11/1937 | Charch | |
| 2,099,162 | A | | 11/1937 | Eberlin | |
| 2,127,956 | A | * | 8/1938 | Helmer | 101/424.1 |
| 2,142,289 | A | * | 1/1939 | Sloan | 261/130 |
| 2,153,325 | A | * | 4/1939 | Cole | 101/416.1 |
| 2,190,046 | A | * | 2/1940 | Robinson et al. | 62/167 |
| 2,268,986 | A | * | 1/1942 | Hess et al. | 34/465 |
| 2,302,327 | A | * | 11/1942 | Kehoe et al. | 73/439 |
| 2,308,239 | A | * | 1/1943 | Bell | 34/657 |
| 2,323,936 | A | * | 7/1943 | Roberts | 428/314.4 |
| 2,395,901 | A | * | 3/1946 | Murphree et al. | 528/501 |
| 2,427,892 | A | * | 9/1947 | Adams | 34/647 |
| 2,432,964 | A | * | 12/1947 | Clark | 34/213 |
| 2,499,141 | A | * | 2/1950 | Helmus | 34/114 |
| 2,545,144 | A | * | 3/1951 | Green et al. | 526/74 |
| 2,578,744 | A | * | 12/1951 | Rusca et al. | 34/421 |
| 2,639,531 | A | * | 5/1953 | Engemann | 40/709 |
| 2,664,282 | A | * | 12/1953 | Mann | 432/55 |
| 2,664,954 | A | * | 1/1954 | Johnson | 166/283 |
| 2,668,700 | A | | 2/1954 | Zimmerman | |
| 2,707,837 | A | | 5/1955 | Robinson et al. | |
| 2,720,915 | A | | 10/1955 | Lenoir | |
| 2,751,448 | A | * | 6/1956 | Timken, Jr. et al. | 200/46 |
| 2,780,572 | A | * | 2/1957 | Carlson | 156/177 |
| 2,791,039 | A | * | 5/1957 | Rosenbaum | 34/655 |
| 2,833,838 | A | * | 5/1958 | Berg | 585/536 |
| 2,862,305 | A | | 12/1958 | Dungler | |
| 2,920,399 | A | * | 1/1960 | Fry, Jr. | 34/647 |
| 2,952,078 | A | * | 9/1960 | Litzler | 34/68 |
| 2,975,499 | A | * | 3/1961 | Lapp | 264/606 |
| 3,015,304 | A | * | 1/1962 | Carlson et al. | 399/154 |
| 3,047,473 | A | * | 7/1962 | Schmidt | 201/4 |
| 3,074,776 | A | * | 1/1963 | Ryan et al. | 423/219 |
| 3,076,321 | A | * | 2/1963 | Schlichtig | 62/270 |
| 3,102,537 | A | * | 9/1963 | Bartlett, Jr. | 128/201.13 |
| 3,123,487 | A | * | 3/1964 | Verdier | 106/253 |
| 3,132,930 | A | * | 5/1964 | Abbott et al. | 34/92 |
| 3,149,003 | A | * | 9/1964 | Christie | 118/34 |
| 3,166,999 | A | * | 1/1965 | Dement | 396/625 |
| 3,174,228 | A | * | 3/1965 | Smith, Jr. | 34/556 |
| 3,176,411 | A | * | 4/1965 | Jepson et al. | 34/122 |
| 3,188,785 | A | * | 6/1965 | Butler | 62/55.5 |
| 3,190,790 | A | * | 6/1965 | Ploetz et al. | 162/212 |
| 3,215,558 | A | | 11/1965 | Dascher | |
| 3,231,985 | A | | 2/1966 | Smith Jr. | |
| 3,235,973 | A | * | 2/1966 | Smith, Jr. | 34/638 |
| 3,237,218 | A | * | 3/1966 | Moore | 114/357 |
| 3,245,062 | A | * | 4/1966 | Kornei | 360/131 |
| 3,246,658 | A | * | 4/1966 | Buchholz et al. | 453/35 |
| 3,252,415 | A | | 5/1966 | Crawford | |
| 3,279,125 | A | * | 10/1966 | Leliaert | 451/86 |
| 3,328,895 | A | * | 7/1967 | Krone et al. | 34/68 |
| 3,343,174 | A | * | 9/1967 | Kornei | 360/59 |
| 3,377,056 | A | * | 4/1968 | Boye | 432/60 |
| 3,378,208 | A | | 4/1968 | Camenisch | |
| 3,390,465 | A | | 7/1968 | Wise | |
| 3,416,237 | A | | 12/1968 | Sutherland et al. | |
| 3,418,723 | A | | 12/1968 | Burgess et al. | |
| 3,446,712 | A | * | 5/1969 | Othmer | 203/11 |
| 3,448,969 | A | | 6/1969 | Windsor | |
| 3,460,818 | A | * | 8/1969 | Werner et al. | 266/179 |
| 3,502,456 | A | | 3/1970 | Fetner | |
| 3,531,946 | A | * | 10/1970 | Hart | 62/332 |
| 3,541,697 | A | * | 11/1970 | Villalobos | 34/115 |
| 3,563,801 | A | * | 2/1971 | Cox | 429/211 |
| 3,570,383 | A | | 3/1971 | Berg | |
| 3,590,495 | A | * | 7/1971 | Tyson et al. | 34/654 |
| 3,643,342 | A | | 2/1972 | Tyson et al. | |
| 3,659,348 | A | * | 5/1972 | Frank | 34/122 |
| 3,676,253 | A | * | 7/1972 | Cox | 156/279 |
| 3,721,016 | A | * | 3/1973 | Lee et al. | 34/125 |
| 3,725,010 | A | * | 4/1973 | Penhast | 422/64 |
| 3,761,237 | A | * | 9/1973 | Jeffreys | 71/9 |
| 3,919,783 | A | | 11/1975 | Cirrito | |
| 4,005,718 | A | | 2/1977 | Prouse et al. | |
| 4,053,279 | A | | 10/1977 | Eichenlaub | |
| 4,116,620 | A | | 9/1978 | Stibbe | |
| 4,146,361 | A | * | 3/1979 | Cirrito | 432/60 |
| 4,175,885 | A | * | 11/1979 | Jeppson | 404/77 |
| 4,259,096 | A | | 3/1981 | Nakamura et al. | |
| 4,290,746 | A | | 9/1981 | Smith | |
| 4,324,613 | A | | 4/1982 | Wahren | |
| 4,326,343 | A | | 4/1982 | Rathmell | |
| 4,326,843 | A | | 4/1982 | Smith | |
| 4,366,824 | A | | 1/1983 | Rainer et al. | |
| 4,373,904 | A | | 2/1983 | Smith | |
| 4,416,618 | A | | 11/1983 | Smith | |
| 4,474,496 | A | | 10/1984 | Rocheleau | |
| 4,498,864 | A | | 2/1985 | Roth et al. | |
| 4,504,200 | A | | 3/1985 | Olson | |
| 4,575,952 | A | * | 3/1986 | Bodenan et al. | 34/567 |
| 4,590,685 | A | | 5/1986 | Roth | |
| 4,622,758 | A | | 11/1986 | Lehtinen et al. | |
| 4,729,548 | A | | 3/1988 | Sullins | |
| 4,783,057 | A | | 11/1988 | Sullins | |
| 4,798,007 | A | | 1/1989 | Eichenlaub | |
| 4,819,444 | A | | 4/1989 | Meckler | |
| 4,936,025 | A | | 6/1990 | Heikkila | |
| 4,989,348 | A | | 2/1991 | Vits | |
| 5,069,801 | A | | 12/1991 | Girovich | |
| 5,090,898 | A | * | 2/1992 | Smith | 431/326 |
| 5,112,220 | A | | 5/1992 | Wimberger et al. | |
| 5,197,203 | A | | 3/1993 | Lenoir | |
| 5,207,008 | A | | 5/1993 | Wimberger et al. | |
| 5,261,166 | A | | 11/1993 | Seeley et al. | |
| 5,281,261 | A | * | 1/1994 | Lin | 106/31.65 |
| 5,416,979 | A | | 5/1995 | Joiner | |
| 5,528,839 | A | | 6/1996 | Seidl | |
| 5,531,818 | A | * | 7/1996 | Lin et al. | 106/31.28 |
| 5,555,635 | A | | 9/1996 | Seidl | |
| 5,737,851 | A | | 4/1998 | Novak et al. | |
| 5,749,164 | A | | 5/1998 | Bowden | |
| 5,771,602 | A | * | 6/1998 | Heikkila et al. | 34/420 |
| 5,830,548 | A | | 11/1998 | Andersen et al. | |
| 5,855,476 | A | * | 1/1999 | Gottschalk | 432/59 |
| 5,966,835 | A | * | 10/1999 | Bakalar | 34/267 |
| 5,968,590 | A | * | 10/1999 | Ahonen et al. | 427/209 |
| 6,022,104 | A | * | 2/2000 | Lin et al. | 347/102 |
| 6,024,824 | A | | 2/2000 | Krech | |
| 6,085,437 | A | | 7/2000 | Stipp | |
| 6,088,930 | A | | 7/2000 | Robin et al. | |
| 6,101,735 | A | * | 8/2000 | Kuhasalo et al. | 34/117 |
| 6,106,659 | A | | 8/2000 | Spence et al. | |
| 6,155,029 | A | * | 12/2000 | Jain | 53/440 |
| 6,214,274 | B1 | | 4/2001 | Melius et al. | |
| 6,258,201 | B1 | | 7/2001 | Krech | |
| 6,264,791 | B1 | | 7/2001 | Sun et al. | |
| 6,293,788 | B1 | | 9/2001 | Novak et al. | |
| 6,308,436 | B1 | | 10/2001 | Stipp | |
| 6,375,817 | B1 | * | 4/2002 | Taylor et al. | 204/453 |
| 6,393,719 | B1 | | 5/2002 | Stipp | |
| 6,432,267 | B1 | * | 8/2002 | Watson | 162/111 |
| 6,481,118 | B1 | | 11/2002 | De Vroome | |
| 6,553,689 | B2 | | 4/2003 | Jain et al. | |
| 6,560,893 | B1 | | 5/2003 | Bakalar | |
| 6,575,736 | B1 | | 6/2003 | Aust et al. | |
| 6,618,957 | B2 | | 9/2003 | Novak et al. | |
| 6,651,357 | B2 | | 11/2003 | Bria et al. | |
| 6,665,950 | B1 | | 12/2003 | Riepe et al. | |
| 6,681,497 | B2 | | 1/2004 | Bria et al. | |
| 6,694,639 | B2 | * | 2/2004 | Hanaya | 34/115 |
| 6,701,637 | B2 | * | 3/2004 | Lindsay et al. | 34/71 |
| 6,708,496 | B2 | | 3/2004 | Gadde et al. | |
| 6,876,394 | B1 | * | 4/2005 | Silverbrook | 348/373 |
| 6,964,117 | B2 | * | 11/2005 | Parent | 34/528 |
| 7,073,514 | B2 | | 7/2006 | Barnes et al. | |
| 7,176,415 | B2 | * | 2/2007 | Kamitani et al. | 219/400 |
| 7,189,307 | B2 | | 3/2007 | Goulet et al. | |
| 7,205,016 | B2 | * | 4/2007 | Garwood | 426/108 |
| 7,229,529 | B2 | | 6/2007 | Goulet et al. | |
| 7,234,471 | B2 | | 6/2007 | Fitzgerald et al. | |
| 7,276,120 | B2 | | 10/2007 | Holmes | |
| 7,297,231 | B2 | | 11/2007 | Goulet et al. | |
| 7,363,929 | B2 | | 4/2008 | Fagg et al. | |
| 7,415,428 | B2 | * | 8/2008 | Garwood | 705/26 |
| 7,481,453 | B2 | | 1/2009 | Breed | |

| | | | | |
|---|---|---|---|---|
| 7,523,603 | B2 | 4/2009 | Hagen et al. | |
| 7,566,381 | B2 | 7/2009 | Goulet et al. | |
| 7,575,770 | B2 * | 8/2009 | Garwood | 426/232 |
| 7,632,434 | B2 | 12/2009 | Duescher | |
| 7,648,164 | B2 | 1/2010 | Breed | |
| 7,740,273 | B2 | 6/2010 | Breed | |
| 7,762,580 | B2 | 7/2010 | Breed | |
| 2002/0046474 | A1 | 4/2002 | Novak et al. | |
| 2002/0095818 | A1 | 7/2002 | Jain et al. | |
| 2002/0114884 | A1 | 8/2002 | Friedersdorf et al. | |
| 2002/0152630 | A1 * | 10/2002 | Lindsay et al. | 34/111 |
| 2003/0019125 | A1 | 1/2003 | Hanaya | |
| 2003/0135181 | A1 | 7/2003 | Chen et al. | |
| 2003/0152679 | A1 * | 8/2003 | Garwood | 426/392 |
| 2003/0165602 | A1 * | 9/2003 | Garwood | 426/392 |
| 2003/0170357 | A1 * | 9/2003 | Garwood | 426/392 |
| 2003/0170359 | A1 * | 9/2003 | Garwood | 426/392 |
| 2003/0175392 | A1 * | 9/2003 | Garwood | 426/392 |
| 2003/0185937 | A1 * | 10/2003 | Garwood | 426/35 |
| 2003/0185948 | A1 * | 10/2003 | Garwood | 426/392 |
| 2003/0230003 | A1 | 12/2003 | Miller et al. | |
| 2004/0081729 | A1 * | 4/2004 | Garwood | 426/235 |
| 2004/0118009 | A1 * | 6/2004 | Parent | 34/446 |
| 2004/0139623 | A1 | 7/2004 | Tafel | |
| 2004/0146602 | A1 * | 7/2004 | Garwood et al. | 426/35 |
| 2004/0185152 | A1 * | 9/2004 | Garwood | 426/383 |
| 2004/0185154 | A1 * | 9/2004 | Garwood | 426/392 |
| 2004/0185155 | A1 * | 9/2004 | Garwood | 426/392 |
| 2004/0185156 | A1 * | 9/2004 | Garwood | 426/398 |
| 2004/0200341 | A1 * | 10/2004 | Walters et al. | 89/1.13 |
| 2004/0219079 | A1 | 11/2004 | Hagen et al. | |
| 2004/0226056 | A1 * | 11/2004 | Roch et al. | 800/12 |
| 2004/0231685 | A1 | 11/2004 | Patel et al. | |
| 2004/0235406 | A1 | 11/2004 | Duescher | |
| 2004/0238136 | A1 | 12/2004 | Patel et al. | |
| 2005/0045294 | A1 | 3/2005 | Goulet et al. | |
| 2005/0045295 | A1 | 3/2005 | Goulet et al. | |
| 2005/0056313 | A1 | 3/2005 | Hagen et al. | |
| 2005/0075030 | A1 | 4/2005 | Coon et al. | |
| 2005/0076925 | A1 | 4/2005 | Fagg et al. | |
| 2005/0076929 | A1 | 4/2005 | Fitzgerald et al. | |
| 2005/0118939 | A1 | 6/2005 | Duescher | |
| 2005/0120715 | A1 * | 6/2005 | Labrador | 60/618 |
| 2005/0122350 | A1 * | 6/2005 | Silverbrook | 347/2 |
| 2005/0208188 | A1 * | 9/2005 | Garwood | 426/392 |
| 2006/0014884 | A1 | 1/2006 | Goulet et al. | |
| 2006/0080819 | A1 * | 4/2006 | McAllister | 29/403.3 |
| 2006/0179680 | A1 | 8/2006 | Miller et al. | |
| 2006/0191160 | A1 | 8/2006 | Miller et al. | |
| 2006/0232052 | A1 | 10/2006 | Breed | |
| 2007/0105980 | A1 * | 5/2007 | Yamamoto et al. | 523/160 |
| 2007/0187056 | A1 | 8/2007 | Goulet et al. | |
| 2007/0193060 | A1 | 8/2007 | Lenoir | |
| 2007/0194274 | A1 | 8/2007 | Goulet et al. | |
| 2007/0225209 | A1 * | 9/2007 | Roch et al. | 514/2 |
| 2007/0228703 | A1 | 10/2007 | Breed | |
| 2007/0264893 | A1 | 11/2007 | Mikaelian | |
| 2007/0292559 | A1 * | 12/2007 | Garwood | 426/2 |
| 2008/0006381 | A1 | 1/2008 | Goulet et al. | |
| 2008/0006382 | A1 | 1/2008 | Goulet et al. | |
| 2008/0067792 | A1 | 3/2008 | Breed | |
| 2008/0082237 | A1 | 4/2008 | Breed | |
| 2008/0104861 | A1 * | 5/2008 | Yahiro | 34/463 |
| 2008/0155985 | A1 * | 7/2008 | Labrador | 60/698 |
| 2008/0243342 | A1 | 10/2008 | Breed | |
| 2008/0256818 | A1 | 10/2008 | Lenoir | |
| 2008/0272580 | A1 | 11/2008 | Breed | |
| 2008/0284145 | A1 | 11/2008 | Breed | |
| 2009/0007453 | A1 * | 1/2009 | Robin et al. | 34/611 |
| 2009/0031581 | A1 * | 2/2009 | Lenoir | 34/611 |
| 2009/0180939 | A1 | 7/2009 | Hagen et al. | |
| 2009/0216910 | A1 | 8/2009 | Duchesneau | |
| 2010/0003904 | A1 | 1/2010 | Duescher | |
| 2010/0012597 | A1 * | 1/2010 | David et al. | 210/774 |

FOREIGN PATENT DOCUMENTS

| | | | |
|---|---|---|---|
| DE | 3148321 (A1) | | 8/1983 |
| DE | 3336998 (C2) | | 1/1984 |
| DE | 3545577 (A1) | | 7/1987 |
| DE | 3738473 (A1) | | 6/1988 |
| DE | 100 28 613 | A1 | 12/2001 |
| EP | 0145424 (A2) | | 6/1985 |
| EP | 0255318 (A2) | | 2/1988 |
| EP | 0255654 (A1) | | 2/1988 |
| EP | 0275156 (A1) | | 7/1988 |
| EP | 0365502 (A2) | | 4/1990 |
| EP | 0416427 (A1) | | 3/1991 |
| EP | 0079474 (A1) | | 5/1993 |
| EP | 0 489 720 | B1 | 7/1997 |
| EP | 1721108 | A2 | 11/2006 |
| EP | 1721109 | A2 | 11/2006 |
| EP | 0 539 013 | * | 9/2009 |
| FR | 2664282 | A1 | 1/1992 |
| FR | 2 771 161 | A1 | 5/1999 |
| FR | 2791039 | A1 | 9/2000 |
| GB | 2142328 (A) | | 1/1985 |
| GB | 2190968 (A) | | 12/1987 |
| GB | 2308239 | A | 6/1997 |
| GB | 2427892 | A | 1/2007 |
| JP | 5-132888 | A | 5/1993 |
| JP | 11-173757 | A | 7/1999 |
| WO | WO 89/06706 (A1) | | 7/1989 |
| WO | WO 89/01044 (A1) | | 11/1989 |
| WO | WO 03/036209 | A1 | 5/2003 |
| WO | WO 2005/085729 | A2 | 9/2005 |

OTHER PUBLICATIONS

Patrick Lenoir, USPTO Notice of Allowance, U.S. Appl. No. 10/591,431, Sep. 17, 2010, 10 pages.

* cited by examiner

INFRARED DRIER INSTALLATION FOR PASSING WEB

FIELD OF THE INVENTION

The present invention concerns a drier installation for a passing web, namely a paper web that has been coated at least on one side in order to produce art paper.

BACKGROUND OF THE INVENTION

More specifically, the infrared drier installation according to the present invention consists of, in a traditional way, the gas-heated infrared radiant elements, arranged one next to the other so as to form a set of at least one row stretching in the transversal direction of the web, more specifically over the entire width of the web.

It is known that the energy released by a gas-heated radiant element is released for nearly 50% as infrared radiation and for the other half as thermal energy of the combustion gases.

Cold air is carried along between the radiant elements and the web by the simple fact that the web passes by at high speed.

In a traditional way, cold air is amongst other things blown upstream the radiant elements and between the radiant elements in order to reduce the temperature of the combustion gases in the neighbourhood of these radiant elements. Consequently, the temperature of the combustion gases that come into contact with the surface of the passing web is thus limited at approximately 300° C., as a result of which the volume of these gases expands, thus supposing the use of powerful ventilators to suck these combustion gases and to recycle them, at least partially, to blow them on the surface of the passing web.

The energy released as infrared radiation is capable of penetrating in the passing web so as to be absorbed by the said web, with an excellent output of the transfer of this radiation energy.

On the contrary, the dilution of the combustion gases with cold air to reduce the temperature of the air and combustion gas mixture that comes into contact with the surface of the passing web considerably reduces the temperature difference between this mixture of air and combustion gas, on the one hand, and the surface of the passing web, on the other hand, thus resulting in a important reduction of the output of the transfer of thermal energy between the gaseous mixture and the passing web that has to be dried.

SUMMARY OF THE INVENTION

The objective of the present invention is to remedy the disadvantages of the existing installations, and to propose an installation of the aforementioned type in which the output of the thermal heat transfers between the combustion gases and the passing web that has to be dried is considerably increased.

According to the present invention, an infrared drier installation for drying a passing web has gas-heated infrared radiant elements arranged one next to the other so as to form a unit, which unit comprises at least two adjacent rows of gas-heated infrared radiant elements stretching out in the transversal direction of the web, substantially over the entire width of the web. The infrared drier installation comprises means to recycle, at least partially, the combustion gases from the gas heated infrared radiant elements. The drier installation as subject of the present invention is characterized in that the infrared drier comprises means to avoid the suction of cold air between two adjacent rows of radiant elements.

Because of the high temperature of the combustion gases, the thermal energy transfers between the combustion gases and the passing web are considerably improved, in proportion to the increase of the temperature difference between the combustion gasses and the surface of the passing web.

The thermal output of the drier installation is thus significantly improved.

Such an improvement of the output of the thermal exchanges between the combustion gases and the passing web that has to be dried allows to consider a reduction of the dimensions of the drier installation, and consequently, of the investment for such an installation, in addition to the reduction of the operation costs related to the aforementioned improvement of the thermal outputs.

The drier installation as subject of the present invention may further comprises means to limit infiltration of cold air and all other parasite air infiltration between the passing strip and the radiant elements. As an example a cold air blowing device may be installed upwards the first rows of radiant elements, blowing air slightly in a direction opposite to the moving direction of the web.

Such means to avoid the suction of cold air between two adjacent rows of radiant elements may e.g. be a sealing gasket mounted between adjacent rows of radiant elements, or an insulating thermal arc stretching out to the neighbourhood of the backside of the radiant elements.

According to the present invention, the drier installation may be equipped with means constituting an insulating thermal arc stretching out to the neighbourhood of the backside of the radiant elements, and these means constitute an insulating thermal arc with the advantage of peripheral walls that stretch out to closely to the web at least along the lateral edges and the upstream transversal edge of the set of radiant elements.

According to the present invention, each radiant element may include first detachable connecting devices adapted to cooperate with the second detachable complementary connecting devices coupled by at least one fixed pipe supplying gas, combustion air or a mixture of gas and air, and the first and second detachable connection devices are made so as to be joined to one another or loosened from one another by one single person placed in front of the front side of the said radiant element.

According to the present invention, the installation may include, for each row of radiant elements, a supply tube of combustion air placed between the radiant elements and the corresponding gas tube, and for each radiant element, the corresponding fixed pipe passes, in a completely tight way, through an opening made in a first region of the wall of the combustion air tube adjacent to the said gas tube, and the corresponding supply tubing of the air and gas mixture passes through an opening in a region of the wall of the air tube adjacent to the said radiant element and has the air inlet opening ending inside the air tube to form the mixture of air and gas.

According to the present invention, the installation may have several ventilators arranged according to a row in the transversal direction of the passing web, and each ventilator is connected to respectively collection hoods and blowing hoods. Preferably each hood is covering an identical part of the width of the passing web. The ventilators are advantageously situated above the collection and blowing hoods, and more preferred adjacent to the corresponding radiant elements, in relation to the said hoods.

Other particulars and advantages of the present invention will appear from the detailed description below.

BRIEF DESCRIPTION OF THE DRAWINGS

The attached drawings only have an exemplary non-limitative function.

DESCRIPTION OF THE PREFERRED EMBODIMENTS OF THE INVENTION

Figure 1:
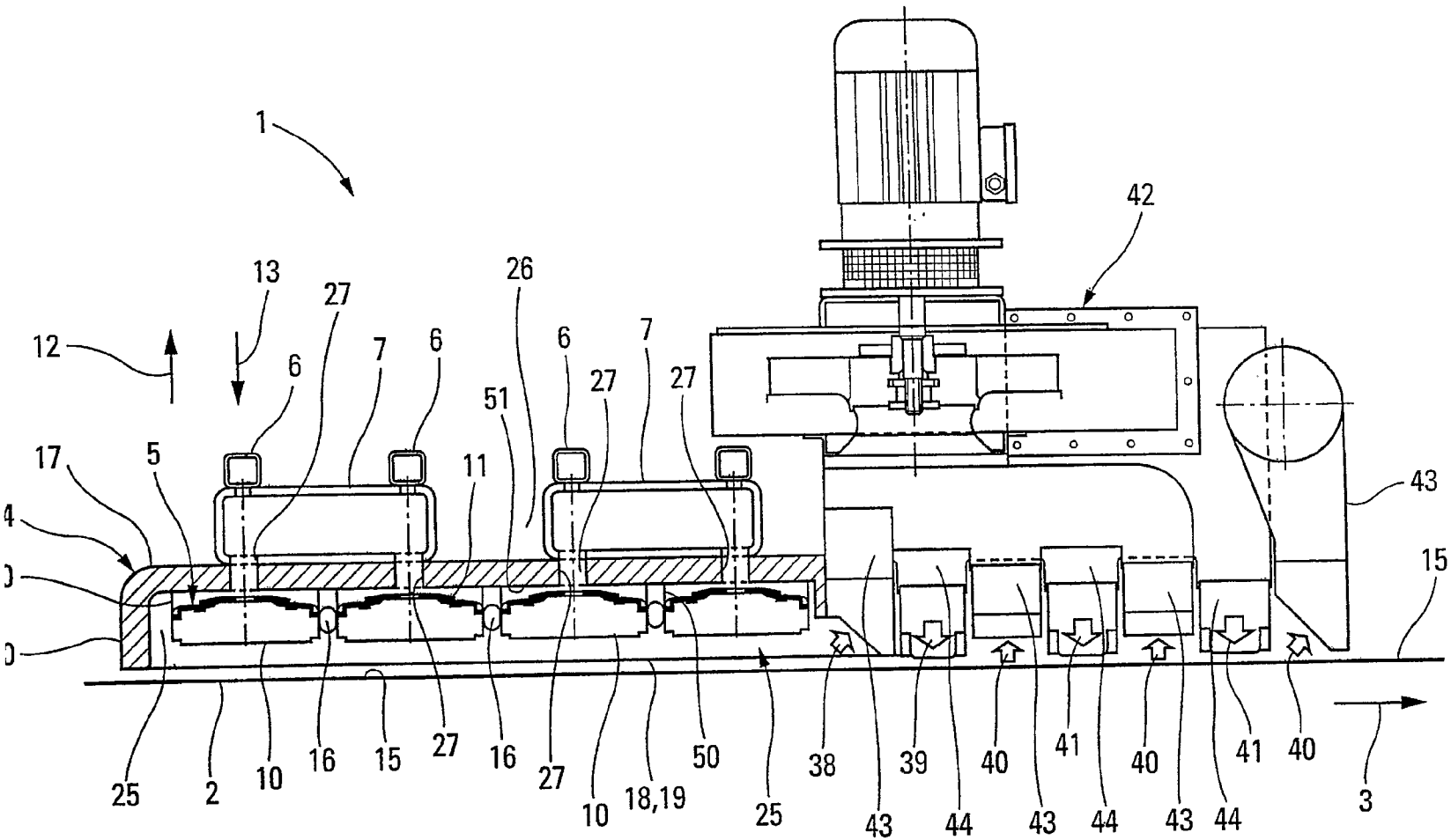
FIG. 1 is a schematic view in a lengthwise cross-section of a realization mode of a drier installation according to the present invention.
Figure 2:
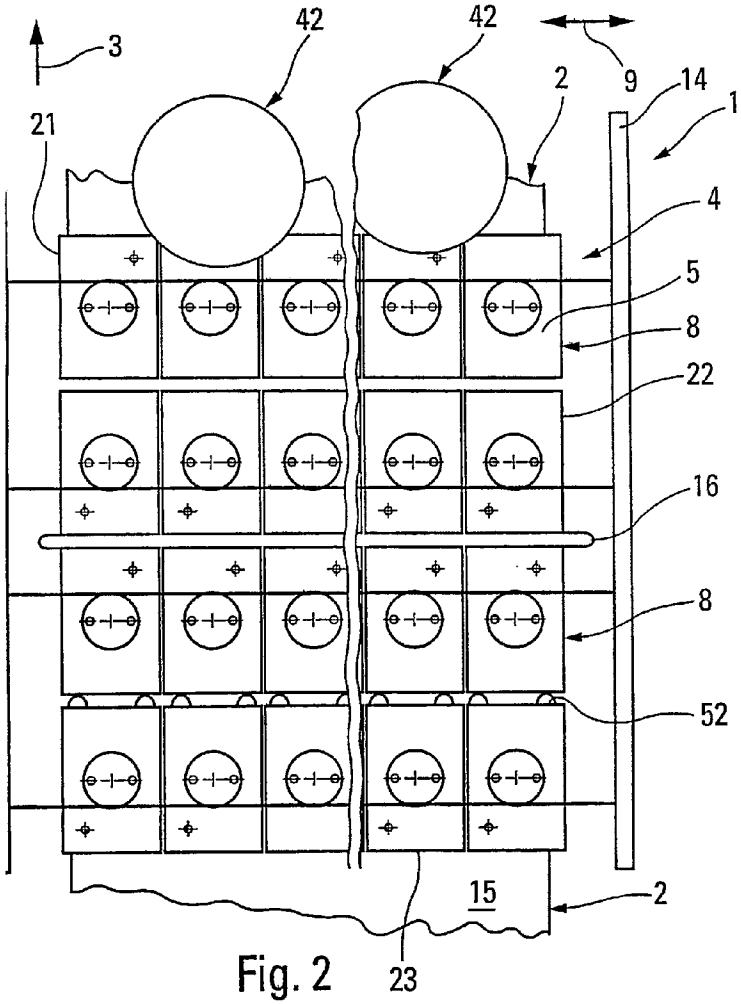
FIG. 2 is a schematic view of a part of the backside of the installation represented in FIG. 1, in which many parts of the installation have been left out to make the figure more clear.

FIGS. 1 and 2 schematically represent a drier installation 1 arranged above a coated passing web that has to be dried, schematised in 2, that moves in the direction represented by the arrow 3, and direction 3 is also the longitudinal direction of the installation 1.

The drier installation 1 for the coated web 2 that passes in the direction of the arrow 3 has a set of 4 gas-heated infrared radiant elements 5 to which the supply of combustion air and gas is ensured by the gas 6 and air 7 tubes.

The radiant elements 5 are arranged one next to the other so as to form at least one and preferably several rows 8, four rows in the represented example, stretching out in the transversal direction 9 of the web 2, over the entire width of the web 2. In a traditional way, the front side 10 of the radiant elements 5 is the side of these elements adjacent to the passing web 2.

The backside 11 of the radiant elements 5 is the side away from the web 2 opposed to the said web 2.

The direction from the front to the back, represented by the arrow 12, e.g. for installing a radiant element 5, thus is the direction away from the web 2, while the direction from the back to the front, represented by the arrow 13, e.g. for removing a radiant element 5, is the direction towards the web 2.

The radiant elements 5 and the air 6 and combustion air 7 tubes are supported by a frame, represented as 14.

The web 2 has been represented horizontally in the figures, with the understanding that the installation 1 can be put in front of a web that moves in any orientation plane, including the vertical plane.

In the example represented in FIG. 1, the installation 1 has means to limit the cold air infiltration between two adjacent radiant elements 5; these means can e.g. consist of sealing gaskets, represented as 16 in FIG. 1, realized in a known sealing material, adapted to resist to the temperature of the combustion gases.

The drier installation 1 also has means that constitute an insulating thermal arc 17 in the neighbourhood of the backside 11 of the radiant elements 5.

The installation 1 may have means to limit the cold air infiltration, and all other parasite air, infiltration between the passing web 2 and the radiant elements 5 in view of obtaining as high a temperature as possible of the combustion gases between the front side 10 of the radiant elements 5 and the superior surface 15, adjacent to the front side 10, of the coated passing web 2. E.g. the means that constitute the arc 17 amongst other things may include the peripheral walls 18, 19 and 20, substantially stretching in the direction 13 perpendicular to the web 2 in the direction of the latter, respectively along the lateral 21 and 22 edges and the upstream transversal 23 edge of the set 4 of radiant elements 5.

The radiant elements 5 are designed so as to endure the high temperature of the combustion gases obtained in that way.

The arc 17 and the walls 18 to 20 can be added or replace the sealing gaskets 16.

The arc 17, substantially parallel to the web 2, the lateral walls 18, 19 and the upstream wall 20, realized in traditional thermal insulation materials, known as such, also constitute an enclosed space 24 providing thermal insulation for a high-temperature internal region 25, limited by the passing web 2 from a low-temperature external region 26, in which the gas 6 and air 7 tubes, and the frame 14 of the installation 1 are traditionally arranged.

This enclosed space 24 reduces thermal losses, more particularly by radiation and convection, and avoids the infiltration of cold air between the radiant elements 5 and between the web 2 and the radiant elements 5.

Obviously, and as represented in FIG. 1, the arc 17 has, for each radiant element 5, at least one hole, represented as 27 in FIG. 1, for the passage of at least one back tubing 28 supplying gas, combustion air or a mixture of air and gas, coupled to the said radiant element 5.

In that way, in spite of the important suction effect, created by the web 2 that passes at high speed in front of the radiant elements 5 and the walls 18, 19, 20, the cold air volume is reduced to a minimum, it concerns the cold air volume that infiltrates or enters either between the web 2 and the set 4 of radiant elements 5, or between the walls 18, 19, 20 and the web 2, or through the arc 17 and between the adjacent radiant elements 5. The temperature of the combustion gases produced by the radiant elements 5 and comprised between the front side 10 of each radiant element 5 and the passing web 2 is thus maximised.

This also applies to the quantity of thermal energy released by the combustion gases to the passing web 2; this quantity of thermal energy is substantially proportional to the temperature difference between the temperature of the combustion gases and the temperature of the web 2.

Obviously, the radiant elements 5 are designed so as to endure the temperature of the thus obtained combustion gases, and more in general, the temperature that reigns between the arc 17 and the web 2.

The presence of the arc 17 and the walls 18, 19, 20 makes it impossible to have access to the backside 11 of the radiant elements 5, and difficult, even impossible, to have access to the necessary connection elements between the fixed gas 6 and air 7 tubes, at the one hand, and each radiant element 5, at the other hand.

According to an advantageous version of the invention, each radiant element 5 has first detachable connecting devices 29 adapted to cooperate with second detachable complementary connecting devices 30 coupled by at least one fixed pipe 31 supplying gas, combustion air or a mixture of gas and air. The first and second detachable connection devices 29, 30 are made so as to be able to be joined to one another or loosened from one another by one single person placed in front of the front side 10 of the said radiant element 5. They constitute e.g. the elements known as such of any known quick connect coupling.

In the represented example, the first and the second connection devices 29, 30 are designed so as to oppose a preset maximal resistance and to yield, in a reproducible way, to a load force that exceeds this maximal resistance. So, it is e.g. possible to foresee first and second connections devices 29, 30 adapted to yield to a load force exercised directly on one of the radiant elements 5, on the one hand, at the installation of a radiant element 5 by directionally pushing the said radiant element 5 from the front to the back of the said radiant element 5, in the direction of the arrow 12, on the other hand, at the removal of a radiant element 5 by a directional traction from the back to the front of the said radiant element 5, in the direction of the arrow 13.

Obviously, it is very important to make sure that the connection devices 29, 30 are situated in the low-temperature region 26 outside the enclosed space 24 formed by the arc 17 and the walls 18, 19 and 20.

It is also possible to foresee other equivalent connection elements, such as e.g. springs that permanently load each radiant element 5 in the direction 12 towards the back and that can simply be detached with an appropriate tool from the front side of the said radiant element 5.

The fixed gas 6 and combustion air 7 tubes can obviously be placed in any possible way in relation to the arc 17, and be connected to each radiant element 5 with first and second connection devices 29, 30 of the type described above.

It is clear that the connection of a radiant element 5 to the gas tube 6 has to be effected in a completely tight way so as to avoid all risks of gas leakages, explosion and fire.

The connection of a radiant element 5 to the air tube 7 can be can be effected in a non-tight way, as a small air leakage can even help to cool down the corresponding connection devices.

Figure 6:
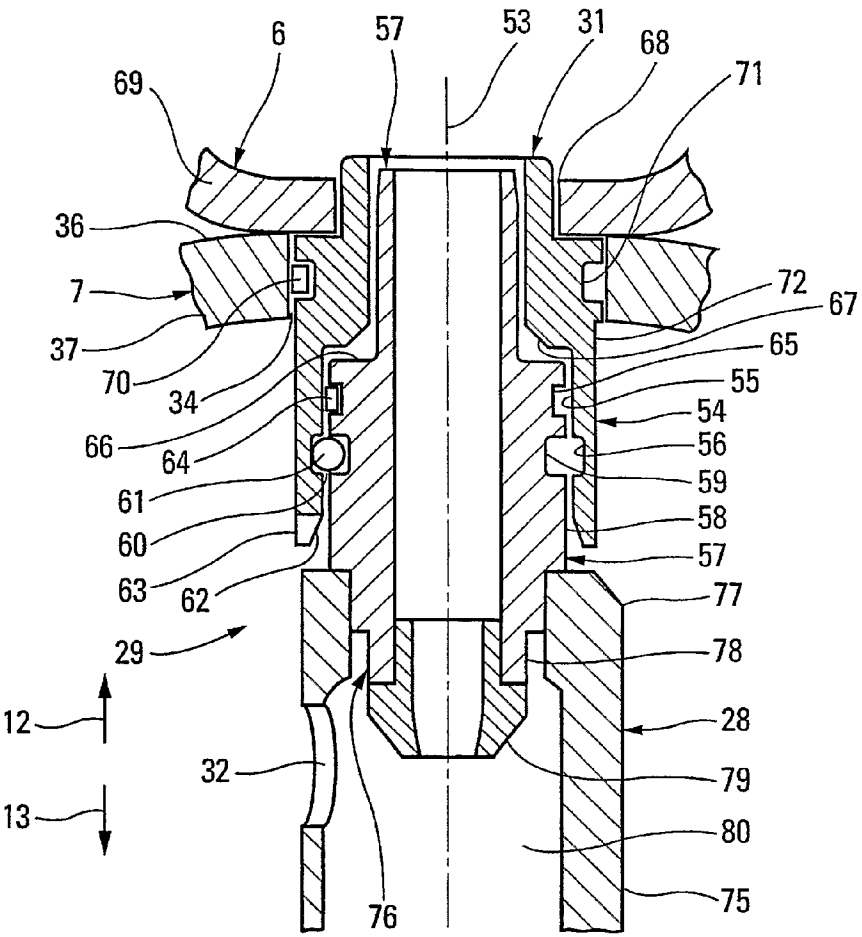
FIG. 6 is an enlarged view of a detail of FIG. 5, showing a realization mode of the detachable connection devices.
Figure 5:
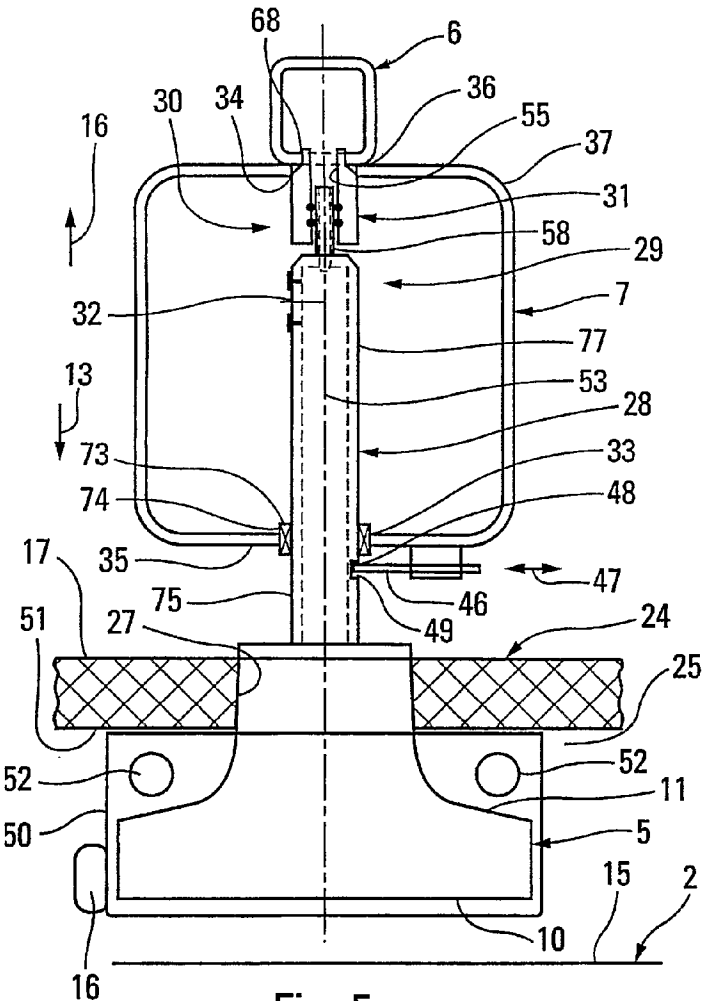
FIG. 5 is a schematic view of an enlarged part of a detail of FIG. 1, showing a radiant element and the connection devices of this radiant element to the gas and combustion air tubes.

In the realization method represented in FIG. 1 and of which a detail is represented schematically in FIGS. 5 and 6, the installation 1 has one gas tube 6 for each row 8 of radiant elements 5.

Each gas tube 6 has, for each radiant element 5, a fixed pipe 31 that supplies gas to the said radiant element 5. As described above, each radiant element 5 has on its backside 11 a back tubing 28 supplying a mixture of air and gas that is adapted to be directly coupled in a detachable and tight way to the corresponding fixed gas pipe 31.

The fixed pipe 31 or the back tubing 28 has an air inlet opening 32 adapted to communicate in any possible way with the corresponding air tube 7 to form the mixture of air and gas, necessary to the good functioning of the corresponding radiant element 5.

In the realization method represented in FIGS. 1, 5 and 6, the installation 1 has, for each row 8 of radiant elements 5, or for several rows 8 of radiant elements 5, two in the represented example, a combustion air supply tube 7 placed between the radiant elements 5 and the corresponding tube, or the corresponding gas tubes 6.

For each radiant element 5, the combustion air tube 7 has opposite openings 33, 34 respectively made in two opposite regions 35, 36 of the wall 37 of the air tube 7, a first opening 33 that is made in a first region 35 adjacent to the radiant element 5, and a second opening 34 that is made in a second region 36 adjacent to the gas tube 7.

Through each of the openings 33, 34 passes the corresponding fixed pipe 31 or the corresponding back tubing 28.

In the example represented in the figures, the corresponding fixed pipe 31 passes in a tight way through the first opening 31 made in the first region 34 of the wall 37 of the combustion air tube 7 adjacent to the gas tube 6.

The corresponding back tubing 28 supplying the mixture of air and gas of the concerned radiant element passes through the second opening 34 made in the second region 36 of the wall 37 of the air tube 7 adjacent to the corresponding radiant element 5. The back tubing 28 has the air inlet opening 32 that ends inside the air tube 7 to form the mixture of air and gas necessary for the functioning of the radiant element 5.

In this installation, the gas 6 and air 7 tubes are indeed installed in the low-temperature region 26 outside the arc 17 and at the walls 18, 19, 20. The same goes for the fixed pipe 31 and the back tubing 28 of each radiant element 5 that are cooled down by the combustion air circulating in the tube 7.

In addition, the drier installation 1 has first collection devices, schematised by the arrow 38 in FIG. 1, to collect downstream the radiant elements 5 at least a part of the warm combustion gases produced by the said radiant elements 5, and first blowing devices, schematised by the arrow 39, to blow on the passing web 2, downstream the first collection devices, air that is warmed up by a part of the combustion gases that were collected before.

In that way, it is possible to blow on the passing web either only previously collected combustion gases, or a mixture of cold air and combustion gas or air that is warmed up in a heat exchanger by thermal exchange with at least a part of the combustion gases, or any other mixture of cold air, and/or warm air, and/or combustion gas.

The installation 1 also has, advantageously, downstream the first blowing devices 38 other collection devices, schematised by the arrows 40 in FIG. 1, to collect the mixture of warm gases present on the passing web 2, and other devices, schematised by the arrows 41 in FIG. 1, to blow on the passing web 2 a mixture of warm gases.

It is known to use at least one ventilator connected to the first and the other collection and blowing devices 38, 39, 40, 41 respectively by means of a realization method of the present invention schematised in FIGS. 1 and 2, the drier installation 1 has several ventilators, schematised in 42, arranged according to a row stretching out in the transversal direction 9 of the passing web 2. Each ventilator 42 is connected to suction hoods, schematised in 43, and to blowing hoods, schematised in 44, respectively covering a largely identical part of the width of the passing web 2.

The ventilators 42 are advantageously situated above the collection and blowing ducts 43, 44, and adjacent to the corresponding radiant elements 5, in relation to the hoods 43, 44.

This arrangement allows to leave out the traditional hoods, that stretch out along the entire width of the passing web 2, connected by ducts to one single powerful ventilator that, because of its size, has to be installed at a distance of the passing web 2.

On the contrary, the aforementioned arrangement allows to install several ventilators 42 of smaller size close to the collection and blowing hoods 43, 44 that are also small-sized themselves.

Figure 3:
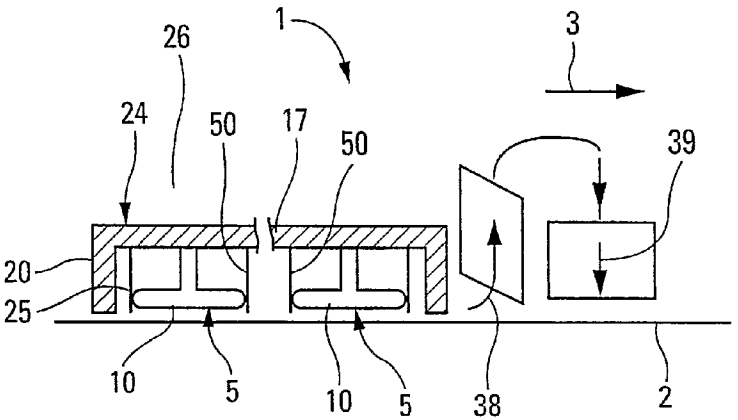
FIG. 3 is a schematic view of a part, similar to FIG. 1, of a variation of the present invention.

In the realization mode schematised in FIG. 3, the first collection devices 38 are not connected to a ventilator and are for instance suction devices combining an injection of compressed air towards the back in the direction 12 perpendicular to the web and away from the latter, in combination e.g. with venturis to guarantee the suction of the hot combustion gases with means that, in comparison to a ventilator rotor, better endure the high temperature of these gases.

The thus sucked combustion gases that are diluted with cold air can be taken back and blown in any way, e.g. by ventilators, on the passing web; the installation has, as described above, a set of blowing and suction ducts alternated for each ventilator.

Figure 4:
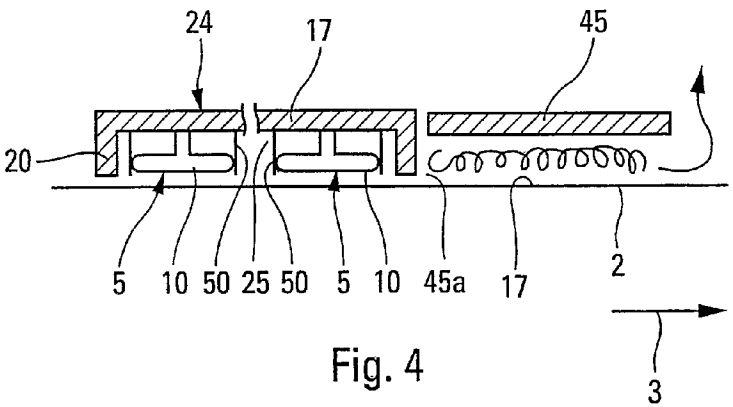
FIG. 4 is a similar view to FIG. 3 of another variation of the present invention.

In the realization mode schematised in FIG. 4, the installation has an insulation thermal arc 45 placed between the radiant elements 5 and the first 38 combustion gas collection means, so as to extend the contact between the passing web 2 and the hot combustion gases.

The insulation arc 45 advantageously has lateral walls (not represented), to maintain the combustion gases in the volume 45*a* above the passing web 2.

In that case, it is possible not to foresee the other collection and blowing devices 40, 41.

To lock and block each radiant element 5 so as to avoid vibrations during the functioning of the installation 1, or an inopportune removal of a radiant element 5, the drier installation 1 has locking devices of any known type to lock each radiant element 5 in its working position. These devices are advantageously designed so as not to require any manual intervention at the backside 11 of the corresponding radiant element 5, and for instance, to oppose to all possible rotations of this radiant element 5.

In the example of FIG. 5, the locking devices constitute of a sliding plate 46 adapted to slide parallel to the web 2 in one direction and the other according to the arrow 47, that can be, freely chosen, the longitudinal direction 3 or the transversal direction 9 of the passing web 2. The plate 46 has, for each radiant element 5, an edge 48 adapted to penetrate in a notch of the corresponding back tubing 28 in order to lock the radiant element 5 in its working position.

In addition, the installation 1 advantageously has, for each radiant element 5, means to insulate the backside 11 and the entire back part situated between the insulating arc 17 and the said radiant element 5 from the warm combustion gases, in view of increasing the resistance to the new thermal loads.

In the represented example, each radiant element 5 is enveloped by a peripheral jacket 50 stretching out in the direction 12 perpendicular to the passing web 2.

The jacket 50 stretches out towards the back from the front side 10 to the surface 51 of the insulating thermal arc 17 facing the passing web 2. The jacket 50 allows to limit the contact between the backside 11 of the radiant element 5 and the combustion products.

This device more particularly allows to avoid an undesired warming-up of the mixture of gas and combustion air that arrives through the back tubing 28.

Each radiant element 5, or the peripheral jacket 50 enveloping each radiant element 5, advantageously has one or more bulges, schematised as 52 in FIGS. 2 and 5, protruding in a direction parallel to the web 2. The bulges 52 are so dimensioned that they rest on a radiant element 5, or on the peripheral jacket 50 of a radiant element 5, adjacent in order to centre each radiant element 5 in relation to the adjacent radiant elements 5 against all possibilities of pivoting around the axis 53 of the back tubing 28 that is confused with the axis of the fixed pipe 31.

FIGS. 5 and 6 represent a preferential realization mode of the first and second detachable connection devices according to the present invention.

The back tubing 28 and the fixed pipe 31 are conformed so that the one (here the fixed pipe 31) constitutes a female sleeve 54 having on its interior peripheral surface 55 at least one annular groove 56, while the other (here the back tubing 28) constitutes a male tubular organ 57 adapted to be inserted inside the female sleeve 54.

The male tubular organ 57 has on its external peripheral surface 58 at least one annular groove 59. The annular grooves 56 and 59 are made in such a way that, in the up position of the tubular organ 57 inside the sleeve 54 represented in the figures, the two annular grooves 56, 59 are situated substantially opposite of one another so as to form an annular aperture 60 in which an annular spring 61 is inserted.

Conversely, the back tubing 28 could be realized as a female sleeve and the fixed pipe 31 in the form of a male tubular organ.

The annular spring 61 imprisoned in the annular grooves 56 et 59 can be put under pressure by a forward traction in the direction of the arrow 13 so that, in an elastic way, it comes in the only annular groove 59 of the back tubing 28 in order to allow the radiant element 5 to be extracted removed the front.

On the contrary, in order to fasten a radiant element 5 on the fixed pipe 31, the male tubular organ 57 with the annular spring 61 held by the annular groove 59 is inserted inside the female sleeve 54, in the direction of the arrow 12 towards the back.

The flattening 62 with truncated cone shape that widens towards the front, in the direction of the arrow 13, at the downstream end 63 of the female sleeve 54, obliges the annular spring 61, when the radiant element 5 is pushed towards the back in the direction of the arrow 12, to deform elastically so that it completely comes inside the groove 59 until the said groove 59 is situated opposite of the groove 56 of the sleeve 54 in order to allow the annular spring 61 to take its normal shape. This thus constitutes a detachable connection method, comparable to a quick connect coupling, of the radiant element 5 on the female sleeve 54 of the fixed pipe 31.

A sealing gasket 64 is, in a traditional way, inserted in a second annular groove 65 of the external peripheral surface 58 of the male tubular organ 57 of the back tubing 28.

In order to accurately define the up position of the male tubular organ 57 inside the fixed pipe 31, this organ 57 presents a receding supporting face 66 that substantially hits a complementary protruding supporting face 67 of the fixed pipe 31.

The fixed pipe 31 is connected in a leak proof way, e.g. by screwing with addition of any known material guaranteeing a gastight connection, in a tapped hole 68 made in the wall 69 of the gas tube 6.

The tightness between the fixed pipe 31 and the edges of the second opening 34 of the air tube 7 is e.g. realized by means of an annular sealing gasket 70 put in an annular groove 71 made on the external peripheral surface 72 of the fixed pipe 31.

In order to simplify the installation of the radiant element 5, the passage of the back tubing 28 through the first opening 33 in the first region 35 of the wall 37 of the air tube 7, is non-tight.

To that end, the back tubing 28 has an external sleeve 73 that envelops the back tubing 28 and of which the external peripheral surface 74 is slightly tapered off towards the back in the direction of the arrow 12, to guide the passage of the back tubing 28 in the first opening 33, and avoid inconvenient play.

The tightness between the external sleeve 73 and the edges of the first opening 33 is unnecessary to the extent that air leaks, if any and in any case weak leaks, do not present any inconvenience and on the contrary present the advantage of cooling down, if necessary, the region situated between the air tube 7 and the backside 11 of the radiant element 5.

On the figures, it can be seen that, in order to simplify manufacture and maintenance, the back tubing 28 has a first piece of tube at the front 75, containing the air inlet opening 32 and a second piece of tube at the back 76, of which the inner diameter is slightly smaller than the inner diameter of the first piece 75 that is fastened e.g. by screwing to the back end 77 of the first piece 75, that constitutes the aforementioned male tubular organ 57.

The second piece of tube at the back 76 has at its front end 78, an organ 79 that functions as a gas injector in the interior volume 80 of the back tubing 28.

The back tubing 28 thus holds the gas injector 79 and the opening 32, in general calibrated, that are consequently accessible when the corresponding radiant element 5 is disassembled.

Obviously, the present invention is not limited to the realization modes described above; and many changes and modifications can be made thereto without leaving the scope of the invention.

It is more particularly possible to use equivalent connection devices, other than the ones describes and adapted so as to allow the installation and the removal of a radiant element 5 at the front, e.g. connection devices with bayonet-fastening, with the understanding that it has in all instance to be possible to obtain a tight connection between the tubing 28 and at least the gas tube 6.

The invention claimed is:

1. A non-contact infrared drier installation for a passing web, comprising:

gas-heated infrared radiant elements arranged next to one another so as to form a unit, wherein the installation heats the web without contacting the web with a heated surface, and said unit comprising at least two adjacent rows of gas-heated infrared radiant elements stretching out in a transversal direction of the web substantially over an entire width of the web, wherein said infrared drier installation comprises a recycling device recycling, at least partially, combustion gases, wherein said infrared drier installation comprises a device preventing suction of cold air between two adjacent rows of radiant elements in said unit, wherein the device preventing suction of cold air between two adjacent rows of radiant elements fills a space between the two adjacent rows of radiant elements in said unit such that a device preventing suction of cold air is located between each and every element in said unit, wherein the device preventing suction of cold air physically blocks a flow of air between the two adjacent rows of radiant elements.

2. A non-contact infrared drier installation according to claim 1, wherein said device configured to avoid the suction of cold air between the two adjacent rows of radiant elements is a sealing gasket.

3. A non-contact infrared drier installation according to claim 1, wherein said drier installation comprises devices that form an insulating thermal arc extending to a vicinity of a backside of the radiant elements.

4. A non-contact infrared drier installation according to claim 3, wherein said devices that form an insulating thermal arc have peripheral walls stretching out to a vicinity of the web, at least along lateral edges and an upstream transversal edge of the unit of radiant elements.

5. A non-contact infrared drier installation according to claim 1, wherein each radiant element has first detachable connecting devices configured to cooperate with second detachable complementary connecting devices coupled by at least one fixed pipe supplying gas, combustion air or a mixture of gas and air, wherein the first and second detachable connecting devices are connected by a quick connect coupling.

6. A non-contact infrared drier installation according to claim 5, wherein the first and the second connecting devices are designed so as to oppose a preset maximal resistance and to yield, in a reproducible way, to a load force that exceeds this maximal resistance.

7. A non-contact infrared drier installation according to claim 5, wherein said drier installation has for each row of radiant elements a corresponding gas tube, which has, for each radiant element, a fixed pipe configured to supply gas to the said radiant element, and wherein each radiant element has on its backside a back tubing configured to supply a mixture of gas and air that is adapted to be directly coupled in a detachable and tight way with a corresponding fixed gas pipe, wherein the fixed pipe or the back tubing has an air inlet opening that communicates with an air tube to provide the mixture of gas and air.

8. A non-contact infrared drier installation according to claim 7, wherein for each row of radiant elements, a combustion air supply tube is placed between the radiant elements and the corresponding gas tube, wherein for each radiant element, the air tube has opposite openings respectively made in two opposite regions of a wall of the air tube: a first opening that is made in a first region adjacent to the radiant element, and a second opening that is made in a second region adjacent to the gas tube, wherein through each of the first and second openings passes the corresponding fixed pipe or a corresponding back tubing.

9. A non-contact infrared drier installation according to claim 8, wherein for each radiant element, the corresponding fixed pipe passes in a tight way through the second opening, wherein the second opening is formed in the second region in the wall of the air tube adjacent to the gas tube, wherein the corresponding back tubing supplying the mixture of gas and air passes through the first opening, wherein the first opening is formed in the first region in the wall of the air tube adjacent to the said radiant element, and includes the air inlet opening that ends inside the air tube to form the mixture of gas and air.

10. A non-contact infrared drier installation according to claim 9, wherein the back tubing of each radiant element has at its front end a gas injector connected to the back tubing.

11. A non-contact infrared drier installation according to claim 1, wherein said drier installation has first collection devices configured to collect downstream of the radiant elements at least a part of the combustion gases produced by the said radiant elements, and first blowing devices configured to blow on the passing web, downstream the first collection devices, a gaseous mixture that is warmed by the combustion gases.

12. A non-contact infrared drier installation according to claim 11, wherein said drier installation has several ventilators, arranged in a row stretching out in a transversal direction of the passing web, wherein each ventilator is connected to collection hoods and to blowing hoods, respectively, which cover at least a part of a width of the passing web.

13. A non-contact infrared drier installation according to claim 12, wherein each ventilator is located above the said collection and blowing hoods, and adjacent to corresponding radiant elements, in relation to the said hoods.

14. A non-contact infrared drier installation according to claim 11, wherein an insulating thermal arc is located between the radiant elements and the first collection devices.

15. A non-contact infrared drier installation according to claim 1, wherein each radiant element comprises a locking device configured to lock said radiant element in a working position.

16. A non-contact infrared drier installation according to claim 1, wherein each radiant element comprises an insulating device configured to insulate the combustion gases from a backside of the radiant element.

17. A non-contact infrared drier installation according to claim 3, wherein each radiant element is enveloped in a peripheral jacket that extends from a front side of the radiant element towards a back to a surface of the insulating thermal arc that faces the passing web.

18. A non-contact infrared drier installation according to claim 1, wherein each radiant element, or a peripheral jacket enveloping each radiant element, has at least a bulge configured to rest on an adjacent radiant element, or on an adjacent peripheral jacket, to prevent pivoting of the radiant element around an axis of a fixed pipe.

19. A non-contact infrared drier installation according to claim 1, wherein said drier installation comprises a device configured to limit infiltration of cold air between the passing web and the radiant elements.

20. A non-contact infrared drier installation according to claim 19, wherein said device configured to limit infiltration of cold air between the passing web and the radiant elements comprises a cold air blowing device installed above a first row of radiant elements configured to blow air slightly in a direction opposite to a moving direction of the web.

21. A non-contact infrared drier installation according to claim 1, wherein the device preventing suction of cold air seals the space between the two adjacent rows of radiant elements.

22. A non-contact infrared drier installation according to claim 1, wherein the device presenting suction of cold air is configured to resist a temperature of the combustion gases.

23. A non-contact infrared drier installation according to claim 1, further comprising an insulating thermal arc positioned on a rear side of the radiant elements.

24. A non-contact infrared drier installation according to claim 1, wherein the recycling device is positioned downstream of the radiant elements.

* * * * *